United States Patent [19]

Fleischhauer

[11] 3,950,814

[45] Apr. 20, 1976

[54] VACUUM CLEANERS

[76] Inventor: Eugene T. Fleischhauer, 176 W. Lane, Revonah Woods, Stamford, Conn. 06905

[22] Filed: Dec. 13, 1974

[21] Appl. No.: 532,613

Related U.S. Application Data

[62] Division of Ser. No. 320,055, Jan. 2, 1973, Pat. No. 3,883,922.

[52] U.S. Cl. ..... 15/327 E; 15/339; 200/83 Z; 200/86.5

[51] Int. Cl.[2] ..... A47L 5/36

[58] Field of Search ..... 15/339, 327 D, 327 E; 200/81 H, 83 C, 83 Z, 86.5

[56] References Cited

UNITED STATES PATENTS

| | | | |
|---|---|---|---|
| 2,795,668 | 6/1957 | Puckett | 200/81 H X |
| 3,353,338 | 11/1967 | Nilsson | 15/327 E X |
| 3,619,850 | 11/1971 | Rideout et al. | 15/327 D X |

FOREIGN PATENTS OR APPLICATIONS

| | | | |
|---|---|---|---|
| 554,793 | 2/1957 | Belgium | 200/81 H |

*Primary Examiner*—Peter Feldman
*Assistant Examiner*—C. K. Moore
*Attorney, Agent, or Firm*—Strauch, Nolan, Neale, Nies & Kurz

[57] ABSTRACT

Canister type vacuum cleaners, which can be used in any of their horizontal and upright positions. The vacuum cleaners include a casing housing a motor and a vacuum pump and a readily accessible compartment for a dust bag. The casing is free of protuberances and is configured so it will slide easily across the surface of the area in which it is used. It may be surrounded with an integral or removable cover to keep the cleaner from damaging furniture, etc., and/or a removable dolly may be attached to increase the mobility of the cleaner. A readily locatable, foot-operated power switch external to the vacuum cleaner casing is also provided to facilitate turning it on and off.

4 Claims, 7 Drawing Figures

VACUUM CLEANERS

This application is a division of application Ser. No. 320,055 filed Jan. 2 1973, which has now matured into U.S. Pat. No. 3,883,922 dated May 2, 1975.

This invention relates to cleaning devices and, more specifically, to novel canister type vacuum cleaners which have a number of advantages over those heretofore available including the cleaners shown in U.S. Pat. No. 1,721,549 to McClatchie; U.S. Pat. No. 2,433,356 to French; U.S. Pat. No. 2,438,133 to Sparklin; U.S. Pat. No. 2,591,305 to Segesman; U.S. Pat. No. 2,634,451 to Dow; U.S. Pat. No. 3,002,215 to MacFarland; U.S. Pat. No. 3,023,838 to Gaudry; U.S. Pat. No. 3,089,177 to Andersson-Sason; U.S. Pat. No. 3,142,857 to Fresard; U.S. Pat. No. 3,270,365 to Waters et al.; U.S. Pat. No. 3,328,826 to Amos; and U.S. Pat. No. 3,621,640 to Ohno et al.

Canister type vacuum cleaners generally consist of a motor and a vacuum pump, a compartment housing a dust filter, a suction hose, an assortment of cleaning tools, a power cord and switch, and a tanklike casing or canister. The motor and pump, dust filter, and power switch are usually located in the canister of the cleaner with the hose communicating through one end of the canister with the dust compartment and the power cord entering the canister at the opposite end.

The canisters of such vacuum cleaners are usually horizontally oriented cylinders or polygonal like boxes and spheres oriented in a variety of attitudes.

To facilitate movement over rugs, bare floors, thresholds, etc., casters, wheels, runners, pneumatic flotation elements, glides, etc., are usually attached to the canisters. Also, elastomeric bumpers are usually provided to reduce contact with furniture and the like. Further, a handle is provided to facilitate carrying the canister from place to place.

Because they protrude from the canister, casters and the like, bumper strips, and handles become engaged with rug edges, thresholds, rocker runners, furniture legs and feet, etc. They also cause the canister to move in undesired directions, defeating their purpose.

Conventional canister type cleaners also have protruding knobs, hinges, latches, etc. and a protrusion at the hose junction, all of which are apt to catch on table and chair legs, sharp corners of furnishings, etc.

These inconvenient and vexatious situations are often compounded by the cleaner being upset when the user tries to dislodge the machine. Then he must stop to right the machine or drag the cleaner in its upset attitude, which increases its tendency to hang up on obstacles and makes the power switch inaccessible or very inconvenient to reach.

In addition to the foregoing inadequacies the usual canister type cleaner is low to the floor and provides a poor and inconvenient platform upon which to drape the hose and/or support the conventional, relatively long, rigid wand. This results in a generally unkempt sprawl of vacuum cleaner and appendages on the floor of the storage area.

I have now invented certain novel, improved vacuum cleaners of the canister type which do not have the above-enumerated drawbacks and are otherwise superior to them as will hereinafter become apparent. Briefly, the novel vaccum cleaners of the present invention include an elongated body or casing contoured so that the cleaner will glide easily across the surface of the area being cleaned.

Preferably, the contour will be selected so that the cleaner can glide easily on its top and sides as well as its bottom, thereby making it orientation insensitive. A base with projecting feet permits the cleaner to be positioned in an upright orientation, which is convenient for storage, in cleaning stair steps, etc. The feet also space the base from the supporting surface so that exhaust air can be discharged through it, even with the vacuum cleaner in the upright orientation and so that a power cord can be conducted to the interior of the casing through the base.

One or more hand grips are formed in the casing so that the cleaner can be readily transported from place-to-place. All hand grips are faired into the casing and the vacuum cleaner is otherwise kept free of protuberances so that there will be no projections to catch on, tangle with, or damage furniture, drapes, moldings, etc.

To further minimize the possibility of causing damage, the casings of my novel vacuum cleaners can be made or provided with an exterior surface layer of a material which will not scuff furniture, floors, or other surfaces. Alternatively, a removable anti-scuff covering may be employed for this purpose.

Housed in one end of the casing are a vacuum pump and an electric motor for driving the pump. These components may be of conventional, commercial construction.

Between the pump and the opposite end of the casing is a compartment for a dust-receiving bag or filter. Access to this compartment is gained through a latchable hinged panel or door in the top or upper wall of the casing.

The bag is typically oriented with its open end surrounding and secured to a tubular fitting for the end of a conventional vacuum cleaner hose extending through the end of the casing in alignment with the longitudinal axis of the casing. With the casing configured as described above, this orientation of the vacuum cleaner hose relative to the casing facilitates the gliding movement of the cleaner.

As indicated above, the novel vacuum cleaners disclosed herein are preferably configured so that they can be readily moved across the surfaces of the areas in which they are being used. To further increase their mobility, a novel detachable, wheeled dolly I have invented can be attached to the cleaner.

Another feature which can be advantageously employed in my vacuum cleaners is a novel bulb-type pneumatic actuator for controlling the flow of current to the vacuum cleaner motor by opening and closing the contacts of a fluid-operated switch. This actuator is located exteriorly of the vacuum cleaner casing. Accordingly, by merely stepping on the actuator, the motor of the cleaner can be readily turned on and off. At the same time there is no risk of damaging the surface on which the actuator rests.

Aside from those discussed above, the novel vacuum cleaners disclosed herein have the advantage of being simple and therefore inexpensive to manufacture and service. They are also easy to manipulate, handle, and store and have the further advantage that they do not leave "tracks" in rugs and similar coverings over which they may be pulled when they are used without a dolly.

From the foregoing it will be apparent to those skilled in the relevant arts that the primary object of the present invention resides in the provision of novel, improved vacuum cleaners of the portable, canister type.

Other important but more specific objects of the invention reside in the provision of vacuum cleaners in accord with the preceding object which:

1. are simple and therefore comparatively inexpensive to manufacture and service and yet efficient in operation.
2. are mobile, convenient to use, versatile, and ceasy to handle and carry;
3. in conjunction with the preceding object, can be provided with a detachable dolly to even further increase their mobility.
4. are compact and easy to store and furnish a support for the vacuum hose and the power cord.
5. substantially eliminate the possibility of scuffing.
6. have a readily accessible and easy to use dust collecting bag or the equivalent.
7. have a novel switching arrangement which facilitates the turning on and off of the vacuum cleaner motor.
8. can be made in a variety of esthetically pleasing shapes or configurations.

Still other important objects and advantages and further novel features of the present invention will become apparent from the appended claims and as the ensuing detailed description and discussion proceeds in conjunction with the accompanying drawing, in which:

FIG. 1 constitutes a side view of a vacuum cleaner in accord with the principles of the present invention with part of the exterior casing of the cleaner being broken away to show its internal components and a sectioned view of a detachable dolly, shown detached from the vacuum cleaner;

Figure 5:
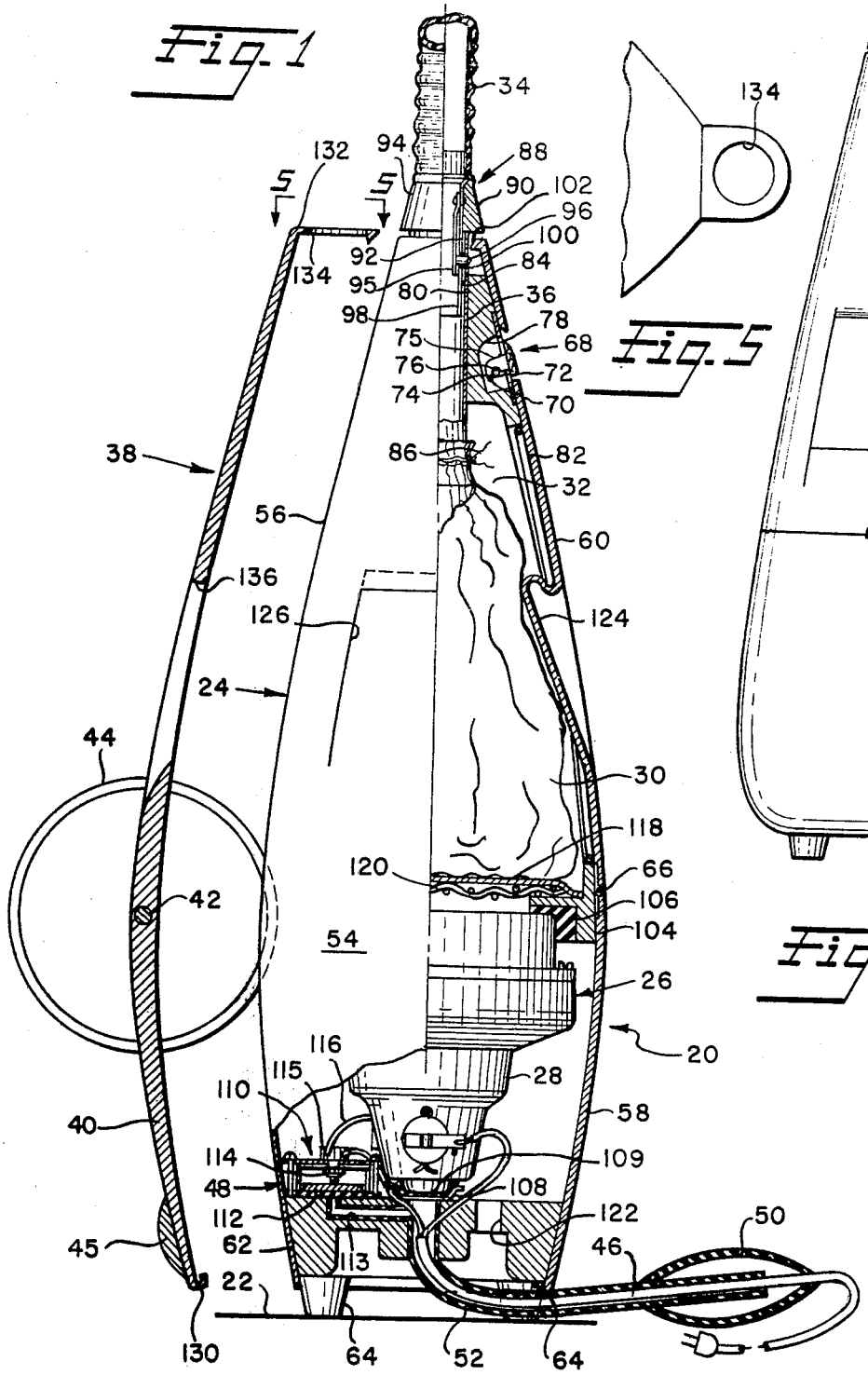
Figure 6:
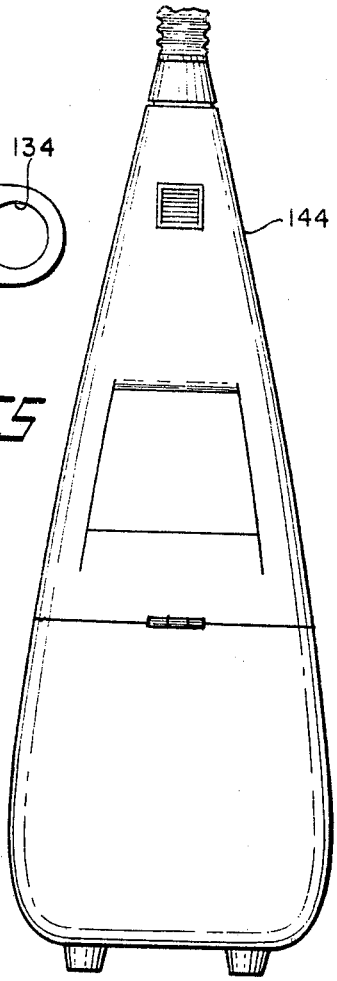
Figure 4:
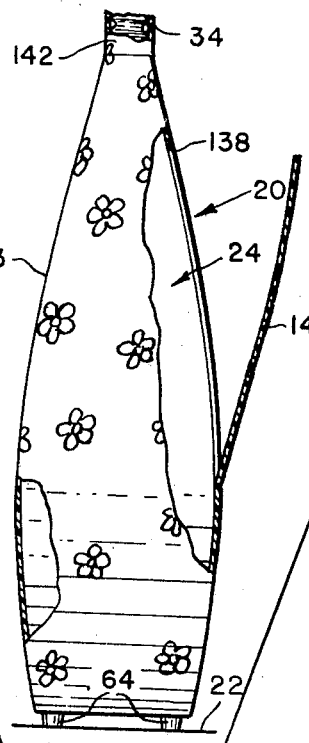
FIG. 4 is a view similar to FIG. 1 but with the exterior casing of the vacuum cleaner intact and an anti-scuff covering in place.
Figure 4A:
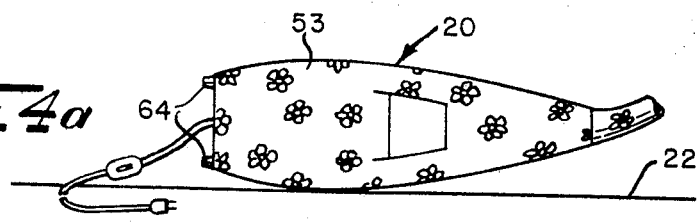

FIG. 4*a* is a view similar to FIG. 4, but showing the vacuum cleaner in a normal horizontal position on a floor surface;

FIG. 5 is a fragmentary view of the detachable dolly of FIG. 1 and is taken substantially along line 5—5 of the latter figure; and FIG. 6 is a top view of a second form of vacuum cleaner in accord with the principles of the present invention.

Figure 2:
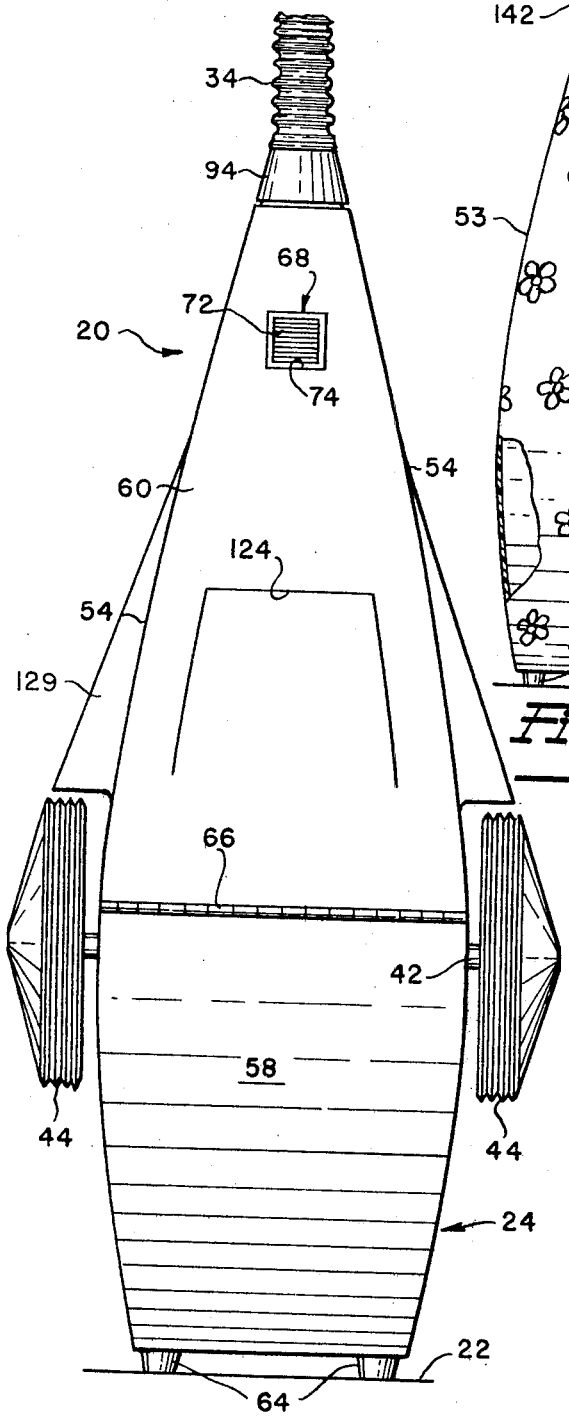
FIG. 2 is a top view of the vacuum cleaner.
Figure 3:
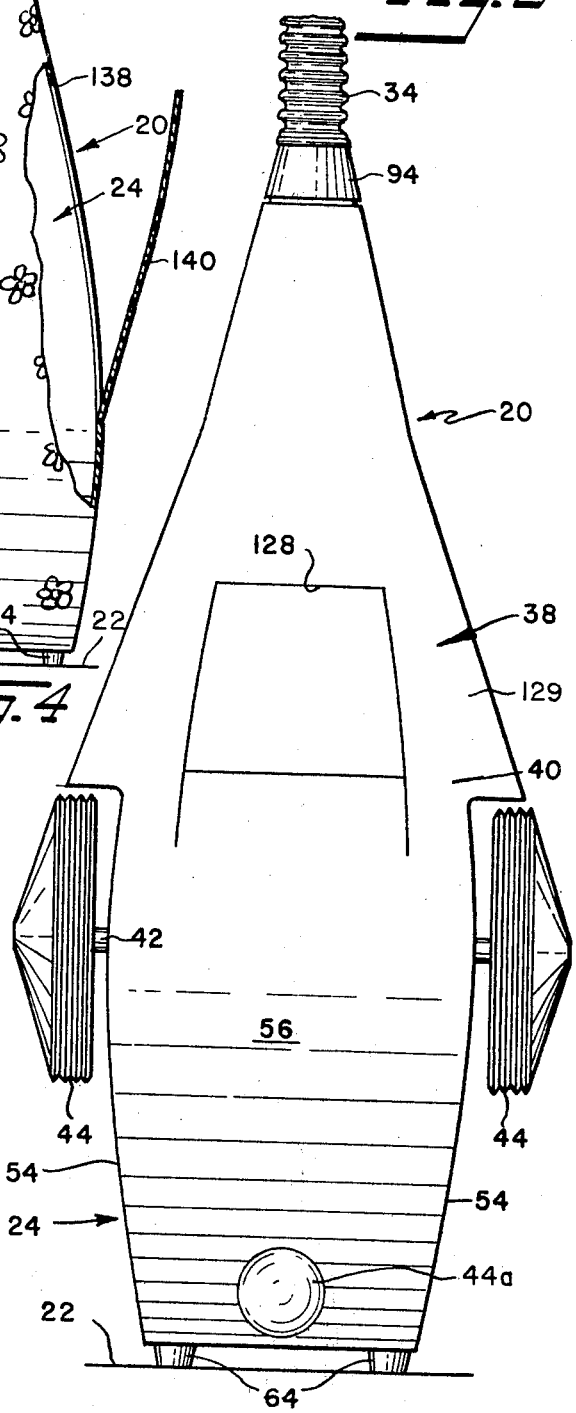
FIG. 3 is a bottom view of the dolly shown attached to the vacuum cleaner.

Referring now to the drawing, FIGS. 1–3 show in detail, a vacuum cleaner 20 constructed in accord with and embodying the principles of the present invention. Vacuum cleaner 20, which is shown supported in an upright position on surface 22, includes an external casing 24 housing a vacuum pump 26, a motor 28 for driving pump 26, and a dustbag 30 in a compartment 32 at the front or upper end of the casing.

A conventional vacuum hose 34 is detachably coupled to the casing at its front or upper end. This hose communicates with the dustbag 30 through a tubular fitting 36 mounted in casing 24.

To increase the mobility of the vacuum cleaner, a detachable dolly 38 can be attached. This dolly includes a base 40, an axle 42 extending transversely across the base, wheels 44 rotatably mounted on the axle on opposite sides of base 40, and a glide button 45 on bottom rear of base 40.

Vacuum cleaner motor 28 is supplied with electrical power through a power cord 46. To turn the motor on and off, the vacuum cleaner is preferably provided with a diaphragm actuator type switch 48, a pneumatic actuator 50, and a pneumatic tube 52 connected between the actuator and switch 48.

As shown in FIGS. 4 and 4*a*, vacuum cleaner 20 may also be provided with an anti-scuff covering 53 to eliminate damage to furniture, floors, etc.

Referring still to FIGS. 1–3, the casing 24 of vacuum cleaner 20 includes side walls 54, a bottom wall 56, and a top wall structure including a stationary member 58 and a pivotable panel or door 60 which furnishes access to bag-holding compartment 32. Each of the four wall structures is continuously convex in a longitudinal direction. This external configuration of the vacuum cleaner makes it slide easily both forward and backward and pivot in response to manipulation of hose 34 or the accessory (not shown) attached to it.

The external configuration also makes the vacuum cleaner insensitive to orientation. This is, as far as its mobility is concerned, it makes no difference whether the vacuum cleaner is upon its bottom, one of its sides, or its top.

Another advantage of this novel casing configuration is that it provides an elongated, relatively slender nose on which the vacuum hose and power cord of the casing can be wound for storage.

The rear or lower end of casing 24 is closed by a base 62 (see FIG. 1) from which feet 64 extend in the direction of the longitudinal axis of the vacuum cleaner. Feet 64 stabilize the vacuum cleaner when it is oriented in the vertical position shown in FIGS. 1–4.

Referring now to FIGS. 1 and 2, the panel 60 which provides access to bag-holding compartment 32 is fixed to immovable top panel 58 as by a piano-type hinge 66 which extends transversely across the vacuum cleaner; i.e., at right angles to its longitudinal center line. The opposite end of panel 60 can be locked in place by a latch 68.

As best shown in FIG. 1, latch 68 includes a mounting plate 70 fixed to the inner side of panel 60. Slidably mounted in mount 70 is an actuator or thumb button 72, which is accessible through an aperture 74 in the panel (see also FIG. 2). Movable with thumb button 72 is a latch member 75, which is engageable with a stop 76 in a recess 78 formed in a member 80 extending between and fixed to the side walls 54 of the casing.

With latch button 72 in the position shown in FIG. 1, latch member 75 engages pin or stop 76 to lock panel 60 in place against a seal 82. Latch button 72 can be slid upwardly as shown in FIG. 1 to free latch member 75 from pin 76, permitting panel 60 to be swung to an open position so that dust bag 30 can be removed and emptied or replaced.

Referring still to FIG. 1, the member 80 from which latching pin 76 is supported also has a central, longitudinally extending bore 84 in which fitting 36 is mounted. The open end of bag 30 is slipped over the lower or rear end of this tube and secured in place as represented by a tie wire 86. The vacuum hose 34 is detachably connected to the upper or front end of tube 36 by a latch 88. This latch includes a button 90 mounted on a spring member 92 supported from a coupling member 94 at the end of the hose. Spring member 92 carries a second resilient member 95 on which a stop 96 is mounted.

The vacuum hose coupling also includes a tubular member 98 dimensioned to slide into tube 36. When tube 93 is fully seated, stop 96 is biased by its resilient support 95 into an aperture 100 in fitting 36 to lock the vacuum hose in place.

To remove the vacuum hose, latch member 90 is depressed, freeing stop 96 from fitting 36. Coupling tube 98 is then free to slide out of tube 36 and through the aperture 102 in the front end of casing 24 to uncouple the vacuum hose.

As shown in FIG. 1, the exterior of the hose coupling is contoured to match the configuration of the vacuum cleaner casing. This eliminates the usual protuberance present at the hose-canister junction.

Referring still primarily to FIG. 1, it was pointed out above that vacuum cleaner pump 26 and motor 28 will typically be commercially available off-the-shelf components. In the illustrated embodiment of my invention, these two components are combined into a single unit supported at one end from casing 24 by bracket 104. A vibration reducing rubber or comparable mount 106 is preferably disposed between bracket 104 and pump 26 to minimize vibration.

The opposite end of the pump/motor unit is supported from the base 62 of casing 24 in bracket 108, from which it is isolated by rubber or similar mount members 109.

Also mounted on base 62 is the switch 48 by which motor 28 is turned on and off. This switch, which is again of a commercially available type, includes a housing 110 in which a diaphragm 112 is mounted. When pneumatic actuator 50 is collapsed as by squeezing or stepping on it, the pressure on the air in it and pneumatic tube 52, which is connected between the actuator and the interor of the switch housing 110 through a bore 113 in base 62, is increased. This moves diaphragm 112 upwardly with vacuum cleaner 20 in the vertical orientation shown in FIG. 1. This displaces a mechanical actuator 114 upwardly closing the switch contacts (not shown) in casing 115 and establishing continuity in the power cord lead 116 in which the switch is interposed. A very small hole or equivalent leak (not shown) is introduced into the pressure system to allow internal static pressure equalization with the atmosphere.

Switch 48 is of the sequential type. Accordingly, a subsequent collapsing of actuator 50 to again increase the pressure on diaphragm 112 effects a displacement of the diaphragm and actuator 114, which causes the switch contacts to open, interrupting the supply of power to motor 28 and turning it off.

The operation of the motor/pump unit is essentially conventional. When motor 28 is energized to operate pump 26, air is caused to flow from the cleaning implement (not shown) attached to vacuum hose 34 through the hose and fitting 36 into dust bag 30. From here the air flows through a secondary pad or filter 118 fixed to support 104 by a filter support grid 120 and into the pump.

Substantially all of the foreign material entrained in the air stream is trapped in bag 30 as the air flows through it. Any foreign substances which may escape from the bag are trapped on filter 118. Accordingly, the air discharged from pump 26 is clean. This cleaned air is exhausted from the interior of casing 24 through exhaust ports 122 in casing base 62.

Turning now to FIGS. 1–3, a hand grip 124 is formed in the top wall 58 of vacuum cleaner casing 24 so that the vacuum cleaner may be carried from place-to-place. This is facilitated because the shape of the vacuum cleaner when oriented in the illustrated, vertical position is such that it is easily carried.

As is apparent from FIG. 1, hand grip 124 is faired into the casing top wall and nowhere protrudes above it. Consequently, the vacuum cleaner will glide as easily on the top and side walls of the casing as on its bottom wall when the vacuum cleaner is used in its typical, horizontal orientation.

Similar hand grips 126 and 128 will typically be formed in the side and bottom walls 54 and 56 of the casing. Accordingly, irrespective of the side of the casing which may be down when the vacuum cleaner is in use, one of the hand grips will be readily accessible.

It was pointed out above that the vacuum cleaner casing configuration illustrated in FIGS. 1–4 makes it highly mobile but that this mobility can be even further increased by use of dolly 38. The base 40 of the dolly is contoured generally to match the bottom wall 56 of vacuum cleaner casing 24, but has fairings 129 which extend out over wheels 44 to keep the latter from causing any scuffing or other damage as the vacuum cleaner is moved about. A bracket 130 fixed to the rear end of the dolly hooks over the rear end of bottom casing wall.

At the front end of the dolly is an integral, upstanding projection 132. When dolly 38 is attached to the vacuum cleaner, tubular fitting 36 extends through an aperture 134 in this projection (see FIG. 5) to fix the front end of the dolly to the vacuum cleaner.

A second aperture 136 is formed in the body of the dolly. This affords access to the hand grip 128 in the bottom of the vacuum cleaner casing when the dolly is in place.

As indicated above, the casing of the vacuum cleaner can be made of or covered with an anti-scuffing material. One type of material suitable for the casing is a vinyl coated metal. Other suitable materials of comparable characteristics will readily occur to those skilled in the arts to which the invention relates.

Alternately, as also previously discussed, a removable covering as identified by reference character 53 in FIG. 4 may be employed to prevent scuffing and other damage. This cover may be formed of any relatively soft material and will preferably be made to completely surround the cleaner with enough give or separable seams with suitable fasteners so that it can be slipped over the vacuum cleaner from its front end and appropriately secured.

An opening 138 is formed in the cover to provide access to panel 60 so that dust bags can be removed and replaced. In normal operation, this opening is covered by a flap 140 secured in place as by snaps, zippers, or similar fasteners (not shown).

To even further minimize the possibility of scuffing, the vacuum hose 34 may also be surrounded by a soft covering as indicated by reference character 142 in FIG. 4.

Referring again to the drawing, it is of course not necessary that the vacuum cleaners I have invented have the precise configuration and polygonal cross section of vacuum cleaner 20. For example, FIG. 6 depicts a vacuum cleaner 144 also embodying the principles of the present invention and having the advantages thereof. This vacuum cleaner differs from vacuum cleaner 20 both in the contour of its longitudinal lines and, also, in that it has a circular transverse crossection.

Still other configurations which can be employed will readily occur to those skilled in the relevant arts.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A canister type vacuum cleaner, which comprises: an elongated outer casing; a motor housed in said casing adjacent one end thereof; a pump housed in said casing and drive-connected to said motor; a suction hose having one end thereof communicating with the interior of the casing, there being a compartment for a bag in the region of said casing into which said hose extends; a power cord extending from said motor through said casing to the exterior thereof; and means for controlling the flow of current through said power cord to said motor which comprises a fluid pressure-actuatable switch in said casing, a foot-activatable pneumatic actuator exteriorly of said casing, and a pneumatic conduit providing fluid communication between said switch and said actuator, said switch being of the sequential type whereby successive activations of the foot-activatable pneumatic actuator will alternately close and open said switch to allow current to flow to said motor and interrupt the flow of current thereto.

2. The vacuum cleaner of claim 1, wherein said power cord comprises a pair of leads connected to said motor and said switch comprises contact means interposed in one of said leads, an actuator member for controlling the opening and closing of said contact means to thereby interrupt and permit the flow of current through said lead, and a diaphragm engageable with said actuator, said pneumatic conduit being in fluid communication with the side of said diaphragm opposite said actuator member.

3. A canister type vacuum cleaner, which comprises: an elongated outer casing; a motor housed in said casing adjacent one end thereof; a pump housed in said casing and drive-connected to said motor; a suction hose having one end thereof communicating with the interior of the casing, there being a compartment for a bag in the region of said casing into which said hose extends; a power cord extending from said motor through said casing to the exterior thereof; and means for controlling the flow of current through said power cord to said motor; said current flow controlling means comprising a fluid pressure-actuatable switch in said casing, a foot-activatable pneumatic actuator exteriorly of said casing, and a pneumatic conduit providing fluid communication between said switch and said actuator; said power cord comprising a pair of leads connected to said motor; said switch comprising contact means interposed in one of said leads, an actuator member for controlling the opening and closing of said contact means to thereby interrupt and permit the flow of current through said lead, and a diaphragm engageable with said actuator; said pneumatic conduit being engageable with the side of said diaphragm opposite said actuator means; and said power cord extending to the exterior of the vacuum cleaner casing through the pneumatic conduit and the pneumatic actuator.

4. A canister type vacuum cleaner, which comprises: an elongated outer casing; a motor housed in said casing adjacent one end thereof; a pump housed in said casing and drive-connected to said motor; a suction hose having one end thereof communicating with the interior of the casing, there being a compartment for a bag in the region of said casing into which said hose extends; a power cord extending from said motor through said casing to the exterior thereof; and means for controlling the flow of current through said power cord to said motor which comprises a fluid pressure-actuatable switch in said casing, a foot-activatable pneumatic actuator exteriorly of said casing, and a pneumatic conduit providing fluid communication between said switch and said actuator, said power cord extending to the exterior of the vacuum cleaner casing through the pneumatic conduit and the pneumatic actuator.

* * * * *